US009735497B2

(12) United States Patent
Wu et al.

(10) Patent No.: US 9,735,497 B2
(45) Date of Patent: Aug. 15, 2017

(54) ELECTRICAL CONNECTOR HAVING A FIXED PART BONDING WITH AN INSULATIVE BODY BY GLUE

(71) Applicant: FOXCONN INTERCONNECT TECHNOLOGY LIMITED, Grand Cayman (KY)

(72) Inventors: Jerry Wu, Irvine, CA (US); Jun Chen, Kunshan (CN); Xiao Fan, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/081,934

(22) Filed: Mar. 27, 2016

(65) Prior Publication Data

US 2016/0285192 A1 Sep. 29, 2016

(30) Foreign Application Priority Data

Mar. 27, 2015 (CN) ..... 2015 2 0177733 U

(51) Int. Cl.

| | |
|---|---|
| ***H01R 13/04*** | (2006.01) |
| ***H01R 13/506*** | (2006.01) |
| ***H01R 13/504*** | (2006.01) |
| ***H01R 13/436*** | (2006.01) |
| *H01R 4/02* | (2006.01) |

(52) U.S. Cl.

CPC ..... *H01R 13/506* (2013.01); *H01R 13/4367* (2013.01); *H01R 13/504* (2013.01); *H01R 4/023* (2013.01)

(58) Field of Classification Search

CPC .... H01R 13/506; H01R 13/504; H01R 13/02; H01R 13/646; H01R 24/28; H01R 24/00

USPC ..... 439/693, 497, 936

See application file for complete search history.

(56) References Cited

U.S. PATENT DOCUMENTS

| | | | | |
|---|---|---|---|---|
| 4,094,564 A * | 6/1978 | Cacolici | ..... | H01R 23/662 439/456 |
| 6,030,252 A * | 2/2000 | Oda | ..... | H01R 13/501 439/470 |
| 6,109,979 A * | 8/2000 | Garnett | ..... | H01R 13/527 439/573 |
| 6,273,749 B1 * | 8/2001 | Yang | ..... | H01R 9/0515 439/497 |

(Continued)

FOREIGN PATENT DOCUMENTS

| | | | |
|---|---|---|---|
| CN | 202930591 | | 5/2013 |
| CN | 202930591 U | * | 5/2013 |
| CN | 104953333 | | 9/2015 |

*Primary Examiner* — Abdullah Riyami
*Assistant Examiner* — Nader Alhawadeh
(74) *Attorney, Agent, or Firm* — Wei Te Chung; Ming Chieh Chang

(57) ABSTRACT

An electrical connector includes a housing and a terminal module mounted in the housing. The terminal module includes an insulative body, a fixed part mounted on the insulative body extending along a back-to-front direction, and a plurality of terminals. The fixed part defines a mounting hole through the fixed part along front-to-back direction. The insulative body has a connecting arm inserting into the mounting hole for position the fixed part on the insulative body. The fixed part defines a pilot hole extending to the mounting hole, and glue is disposed into the pilot hole to bond the fixed part with the insulative body.

18 Claims, 10 Drawing Sheets

(56) References Cited

U.S. PATENT DOCUMENTS

| | | | | |
|---|---|---|---|---|
| 6,863,559 | B2 * | 3/2005 | Yu | H01R 12/79 439/497 |
| 7,238,036 | B2 * | 7/2007 | Sato | H01R 13/506 439/236 |
| 7,828,589 | B2 * | 11/2010 | Cheng | H01R 12/777 439/452 |
| 9,437,981 | B2 * | 9/2016 | Wu | H01R 4/023 |
| 2012/0076462 | A1 * | 3/2012 | Wu | G02B 6/3817 385/89 |
| 2012/0156930 | A1 * | 6/2012 | Wang | H01R 13/6585 439/620.05 |
| 2013/0183845 | A1 * | 7/2013 | Tan | H01R 13/5202 439/271 |
| 2014/0073185 | A1 | 3/2014 | Siahaan et al. | |
| 2014/0106608 | A1 * | 4/2014 | Howarth | F16M 13/02 439/531 |
| 2015/0171554 | A1 * | 6/2015 | Beltzer | H01R 13/629 439/680 |
| 2016/0093976 | A1 * | 3/2016 | Wu | H01R 13/6271 439/660 |

* cited by examiner

ELECTRICAL CONNECTOR HAVING A FIXED PART BONDING WITH AN INSULATIVE BODY BY GLUE

BACKGROUND OF THE INVENTION

1. Field of the Invention

The present invention relates to an electrical connector, especially to a electrical connector high-speed transmitting signal.

2. Description of Related Arts

China Patent No. 202930591, issued on May 8, 2013, discloses a cable connector assembly including an insulative housing, a number of conductive terminals, and a fixed part. The fixed part has a tuber in each of two side faces. The insulative housing has two guide grooves. The tuber is locked in the guide groove. Although the structure of the insulative housing and the fixed part is simple, it may be unstable such that the tuber easily drops out of the guide groove.

An improved positional structure of the insulative housing and the fixed part is desired.

SUMMARY OF THE INVENTION

An object of the present invention is to provide an electrical connector including a reliable positional structure.

To achieve the above-mentioned object, an electrical connector includes a housing and a terminal module mounted in the housing. The terminal module includes an insulative body, a fixed part mounted on the insulative body extending along a back-to-front direction, and a plurality of terminals. The fixed part defines a mounting hole through the fixed part along front-to-back direction. The insulative body has a connecting arm inserting into the mounting hole for position the fixed part on the insulative body. The fixed part defines a pilot hole extending to the mounting hole, and glue is disposed into the pilot hole to bond the fixed part with the insulative body.

Other objects, advantages and novel features of the invention will become more apparent from the following detailed description when taken in conjunction with the accompanying drawings.

DETAILED DESCRIPTION OF THE PREFERRED EMBODIMENT

Figure 1:
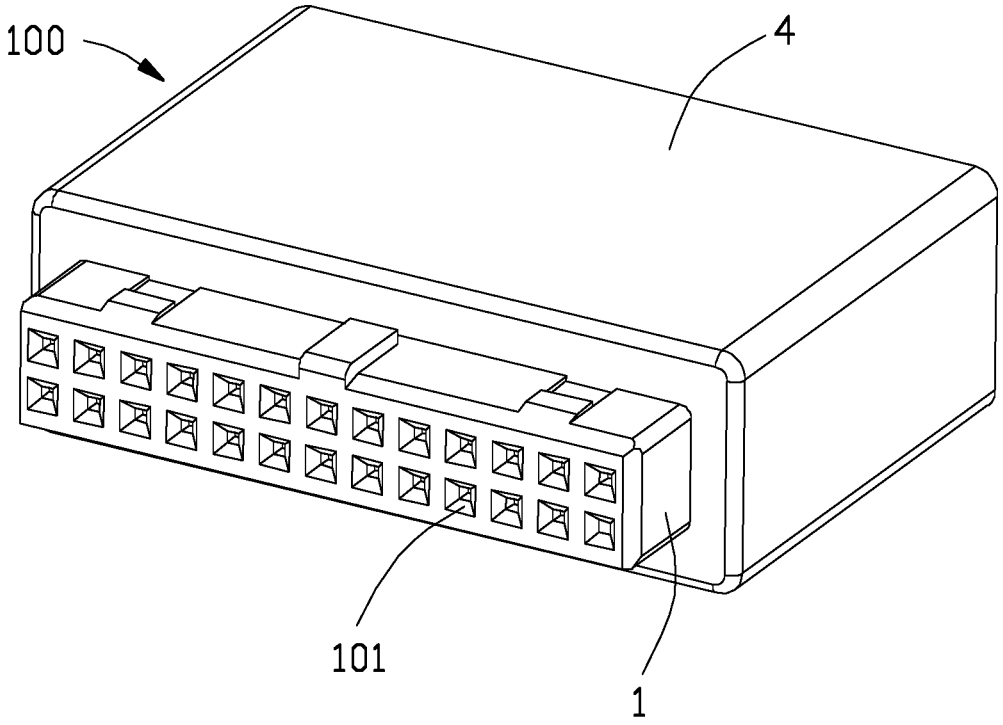
FIG. 1 is a perspective view of an electrical connector according to the present invention.
Figure 2:
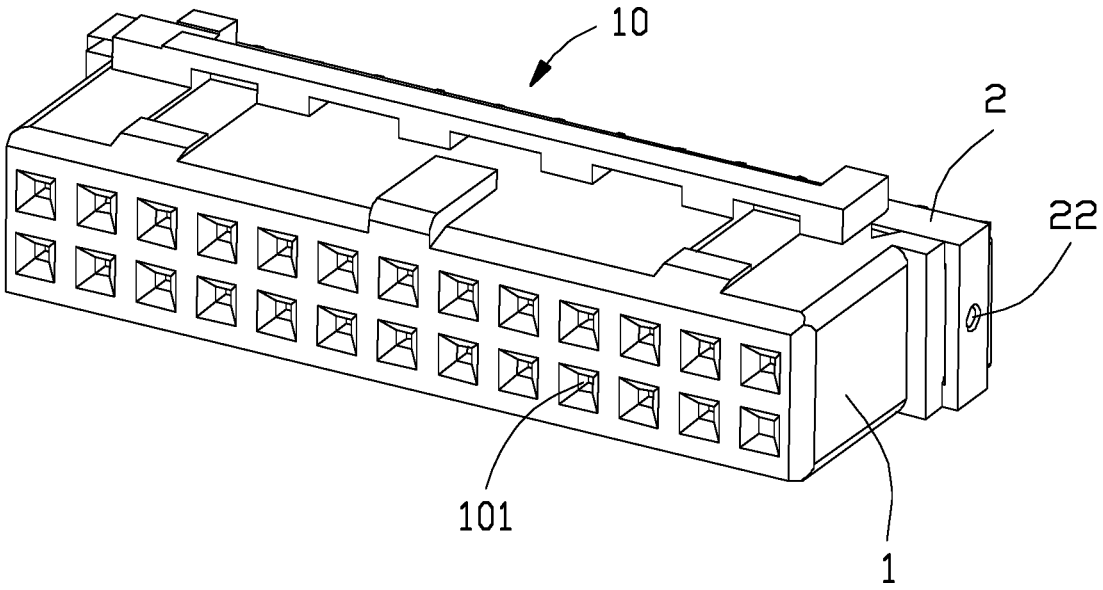
FIG. 2 is a perspective view of a terminal module of the electrical connector as shown in FIG. 1.
Figure 3:
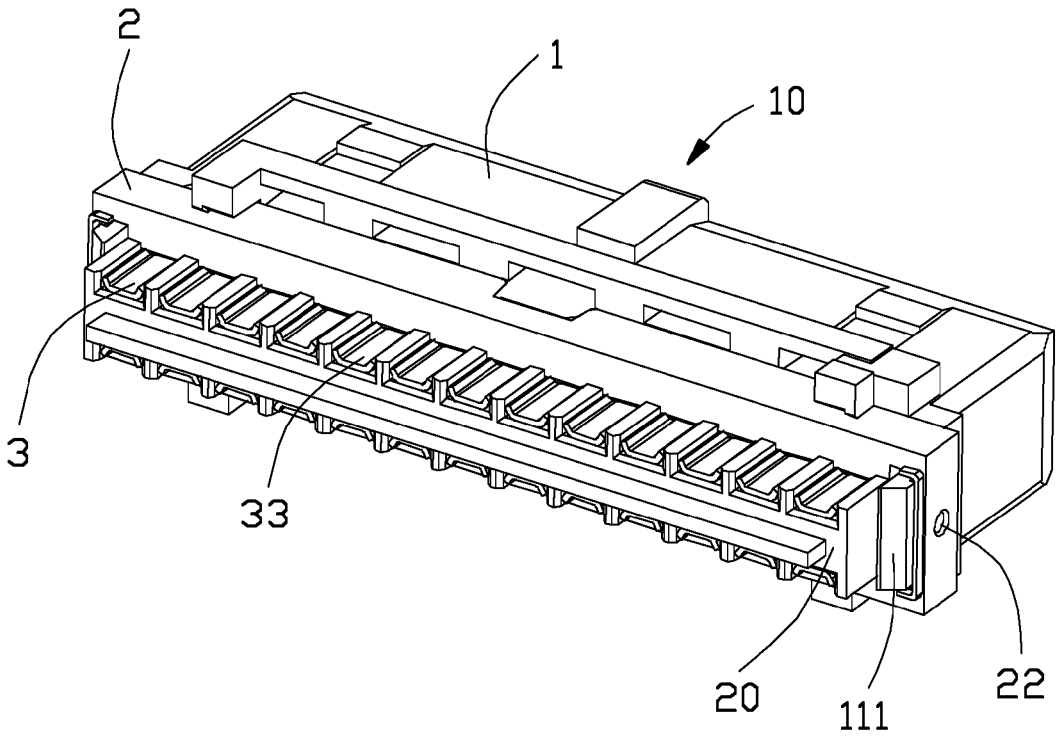
FIG. 3 is an another perspective view of the terminal module as shown in FIG. 2.
Figure 4:
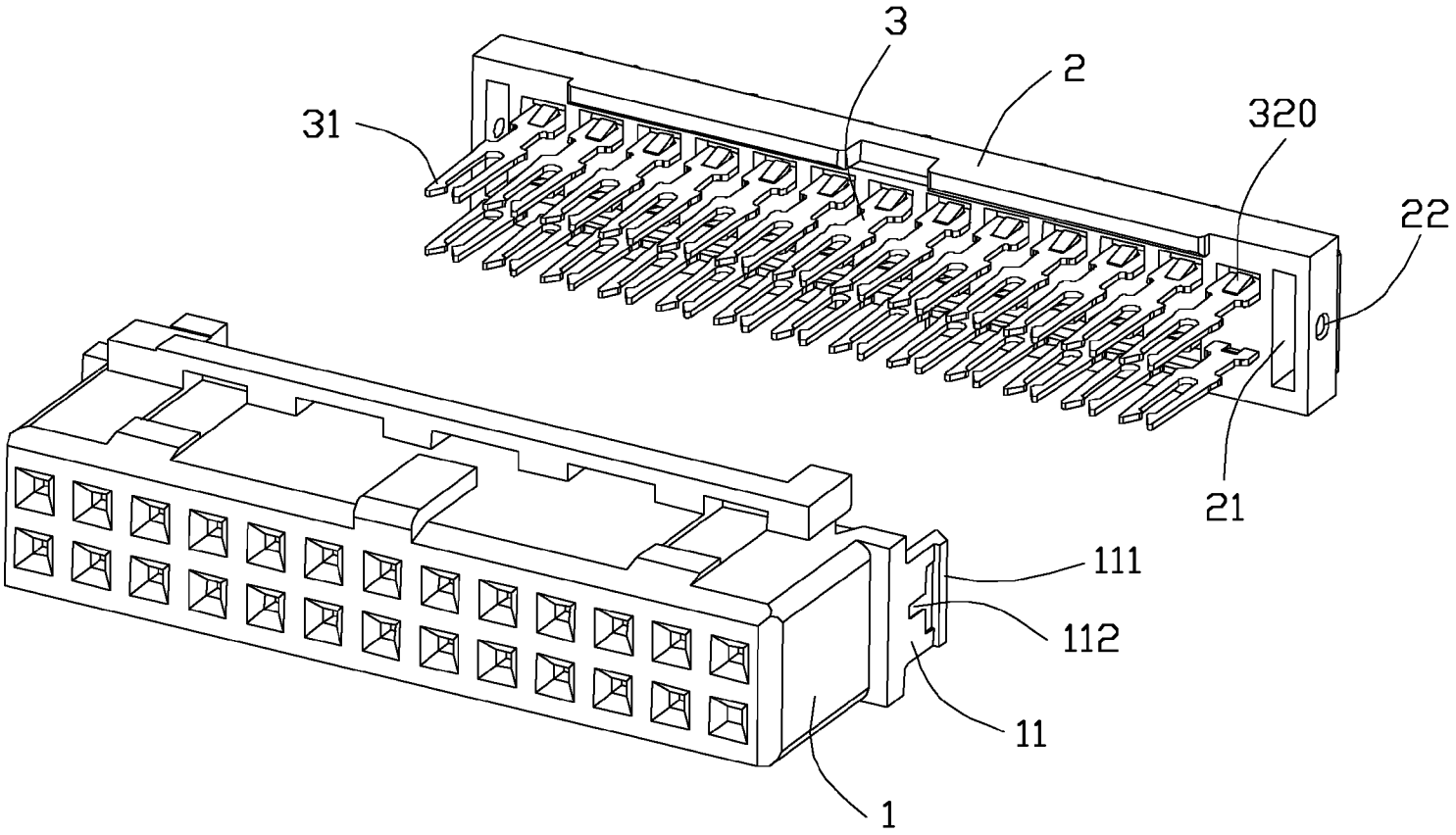
FIG. 4 is a partially exploded view of the terminal module as shown in FIG. 2.
Figure 5:
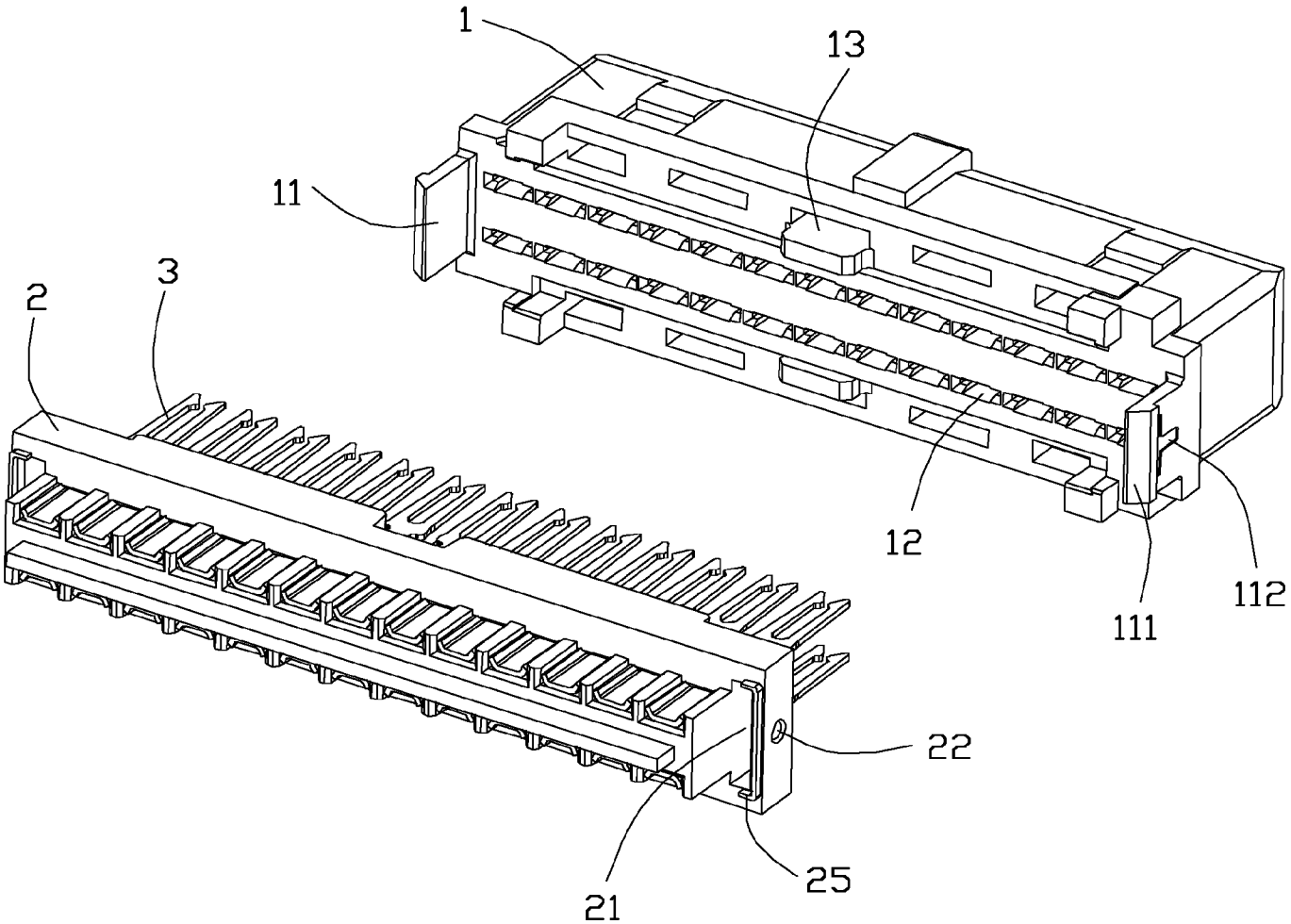
FIG. 5 is a partially exploded view of the terminal module as shown in FIG. 3.
Figure 6:
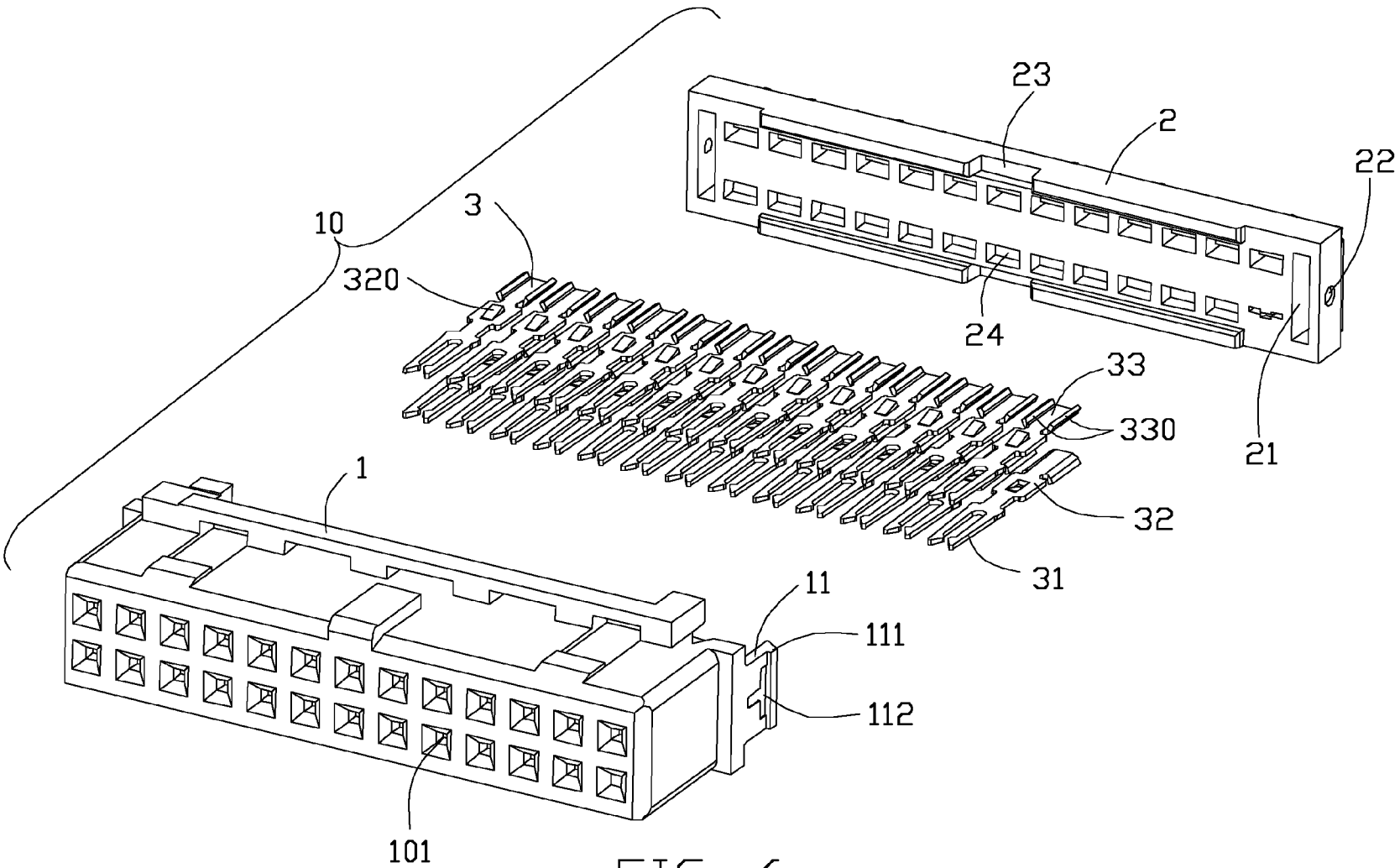
FIG. 6 is a completely exploded view of the terminal module as shown in FIG. 2.
Figure 7:
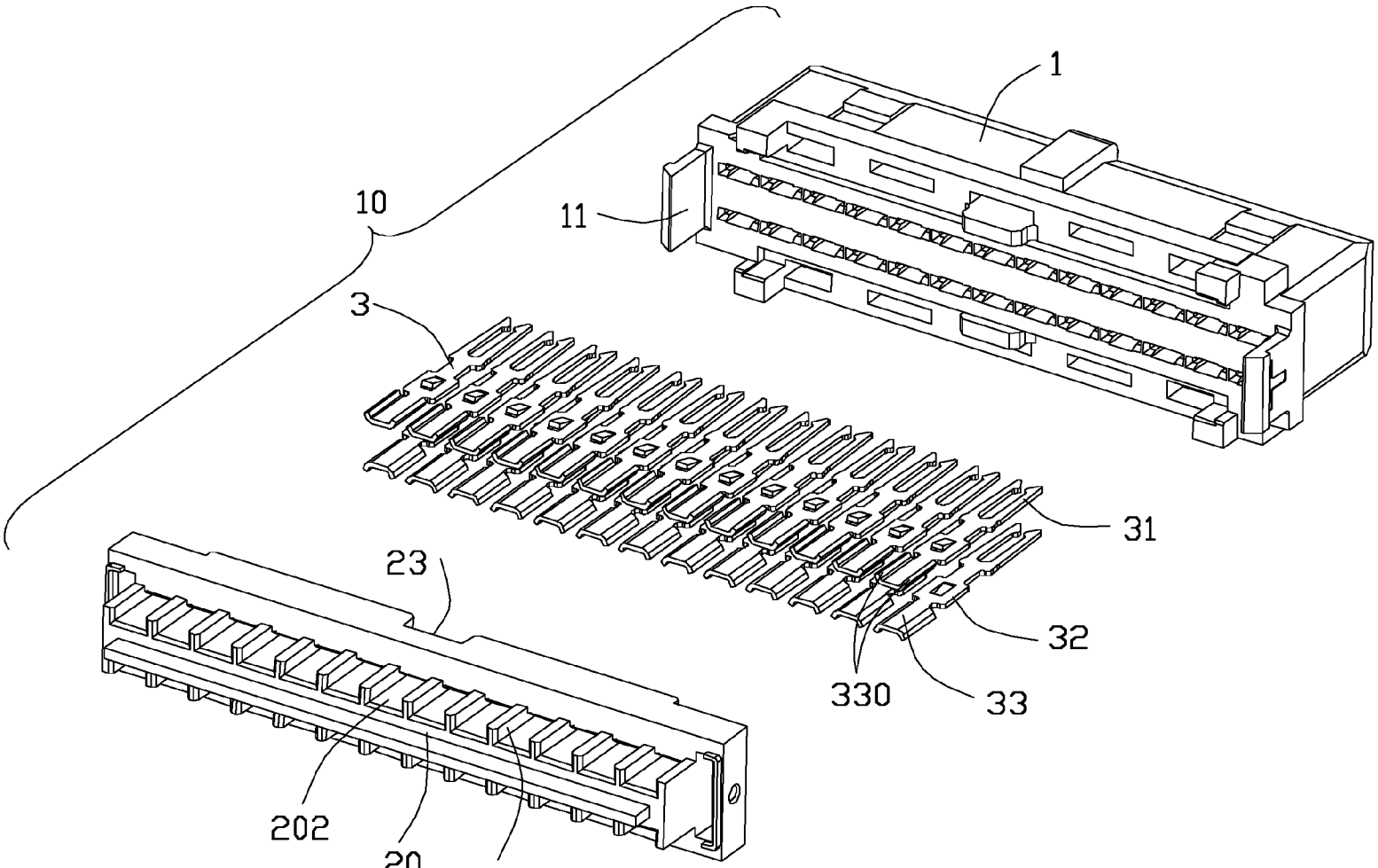
FIG. 7 is a completely exploded view of the terminal module as shown in FIG. 3.

Reference will now be made in detail to the preferred embodiment of the present invention.

Referring to FIGS. 1-7, an electrical connector 100 can connect with at one end a cable including a plurality of wires (not shown). The electrical connector 100 includes a housing 4 and a terminal module 10 mounted in the housing 4. The terminal module 10 includes an insulative body 1, a fixed part 2 mounted on the insulative body 1 along a back-to-front direction, and a plurality of terminals 3 mounted on the fixed part 2. The terminal 3 includes a connecting or tail portion 33 electrically connecting with a corresponding wire of the cable.

The terminal 3 further includes a fixed portion 32 inserted into the fixed part 2 and a mating portion 31 extending into the insulative body 1 for connecting with a mating connector. The fixed portion 32 of the terminal 3 defines a barb or tab 320.

The insulative body 1 forwardly defines a number of mating hole 101 for receiving mating terminals and a receiving hole 12 connecting with the mating holes 101. The mating portion 31 mounted into the mating hole 101 through the receiving hole 12. The insulative body 1 further includes two connecting arms 11 rearwardly extending in two side faces, and a guide post 13 rearwardly extending in middle of the insulative body 1. The connecting arm 11 defines a locking barb 111 at end and a T-shaped diversion tank or glue escape slot 112 near to the locking barb 111.

The fixed part 2 defines a mounting hole 21 for receiving the connecting arm 11 in two sides. The connecting arm 11 has a certain elasticity. After the connecting arm 11 insets through the mounting hole 21, the locking barb 111 locking on the mounting hole 21, so fixed part 2 mounted on the insulative body 1 as a whole. In this embodiment, the fixed part 2 further respectively defines a pilot hole 22 extending from the side face to the mounting hole 21. After the connecting arm 11 insets through the mounting hole 21, the pilot hole 22 linking with the diversion tank 112, glue can be poured into the pilot hole 22 and flow into the diversion tank 112. A cross section of the mounting hole 21 is quadrilateral. The fixed part 2 has a partition 25 distributed on three edges of the mounting hole 21 forming a U-shaped. The partition 25 prevents the glue to overflow from the edges of the mounting hole 21. If the glue overflows the exterior of the product will be damaged. The fixed part 2 further includes a number of position holes 24 for receiving the fixed portion 32 of the terminal 3. The terminals 3 are mounted on the fixed portion 32 along a front-to-back direction, then the terminals 3 and the fixed portion 32 are mounted into the insulative body 1 along a back-to-front direction. The terminals 3 are sandwiched between the fixed part 2 and the insulative body 1.

The fixed part 2 further includes a plate 20 rearwardly extending and defines a guide passageway 23 for receiving the guide post 13 of the insulative body 1. The guide passageway 23 and the guide post 13 make the fixed part 2 precisely positioned with the insulative body 1 in the lateral direction. The plate 20 defines a number of flanges or ribs 201 on two sides. The flange 201 is between the neighbored connecting portions 33 of the terminals 3. Two adjacent flanges 201 form a receiving slot 202. The connecting portion 33 is received in the corresponding the receiving slot 202. When the cable electrically connects with the terminals 3 by welding, the receiving slot 202 prevents to have a short circuit. In this embodiment, the terminals 3 are uniformly distributed on the two sides of the plate 20.

Relative to the existing technology, in present invention, the insulative body 1 and the fixed part 2 firstly engage each other, and the glue flow from the pilot hole 22 to the diversion tank 112. The glue makes the insulative body 1 and the fixed part 2 stick each other more firmly, the electrical connector 100 gets stable connection. Notably, in this embodiment the connecting arm is formed on the insulative body and the mounting hole is formed in the fixed part alternately the connecting arm may be formed on the fixed part and the mounting hole is formed in the insulative body. Anyhow, the glue links the insulative body and the fixed part in a (either a long side or a short side) transverse direction perpendicular to the front-to-back direction. On the other hand, the front-to-back direction essentially refers to both opposite directions along the front-to-back line.

Figure 8A:
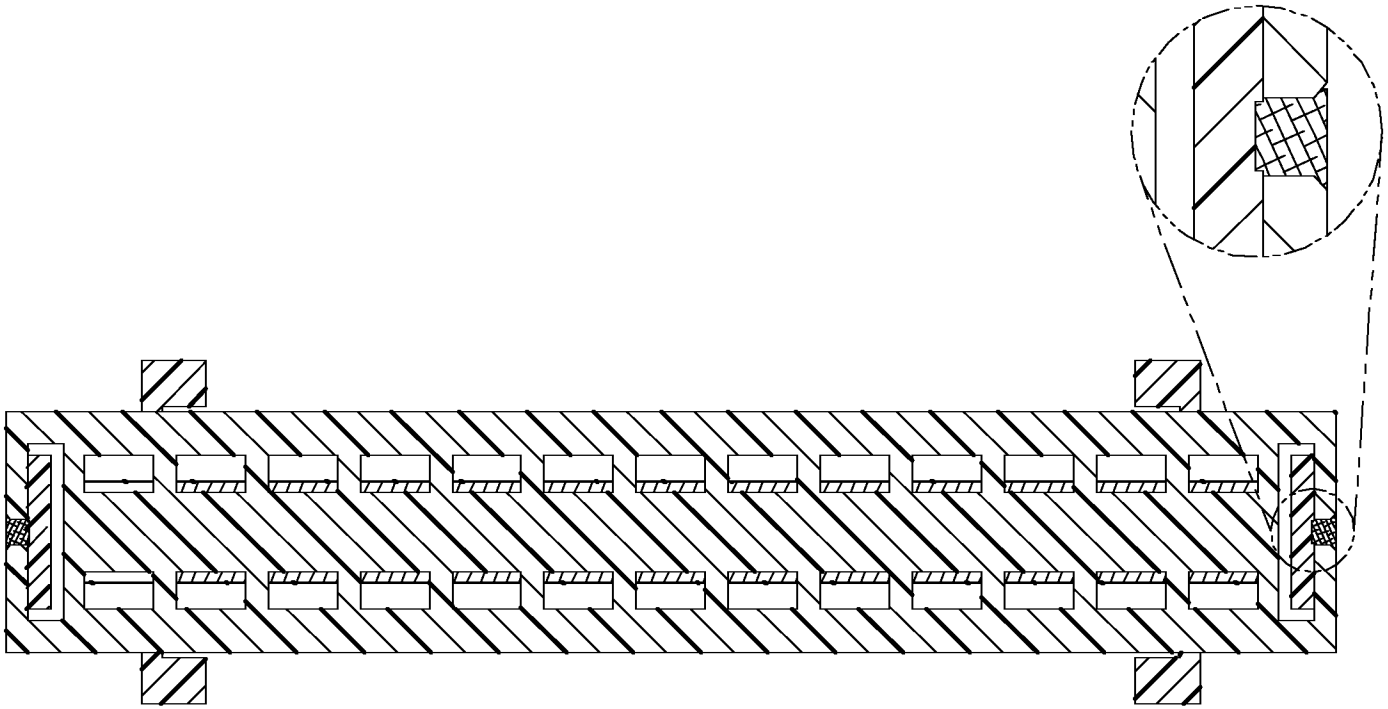
FIG. 8(A) is a cross-sectional view of the terminal module of FIG. 3.
Figure 8B:
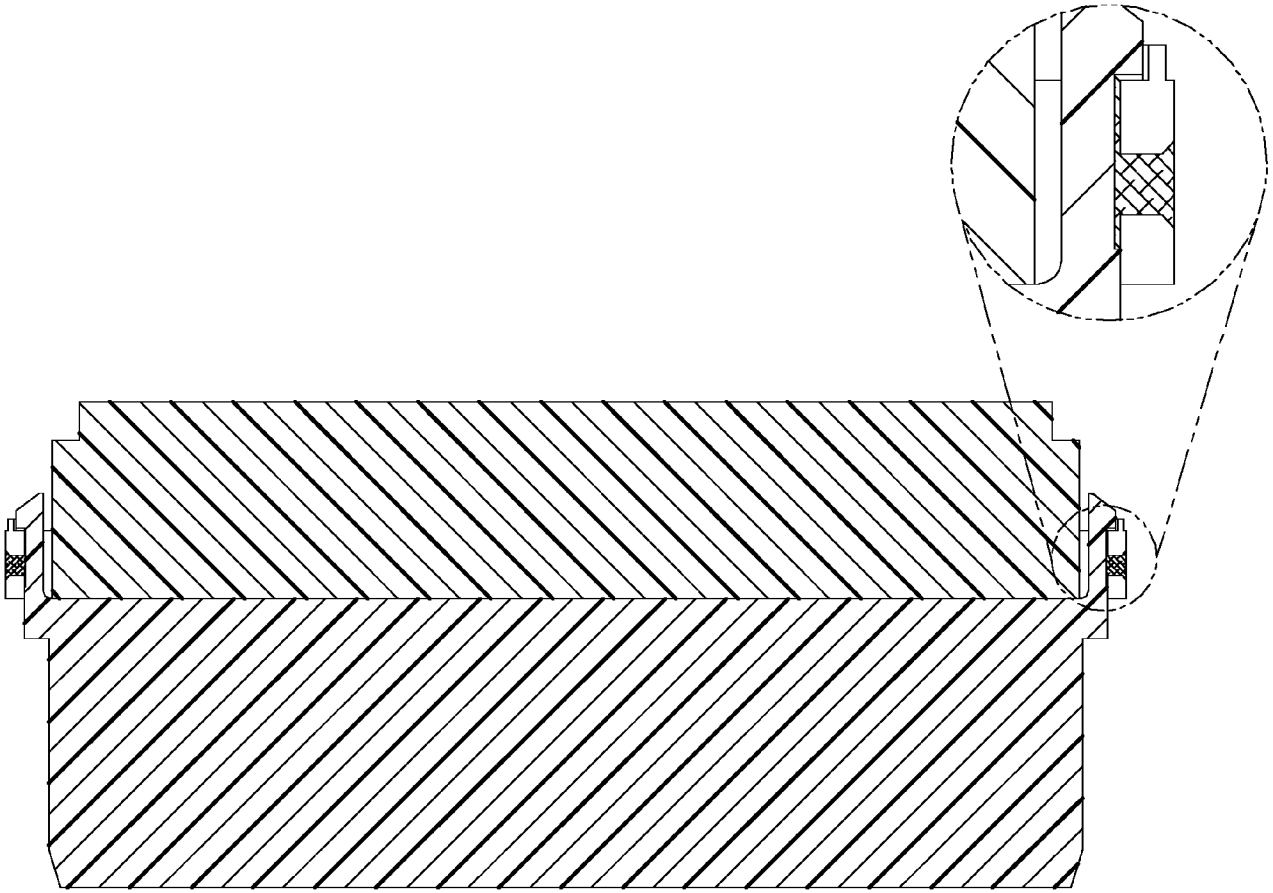
FIG. 8(B) is another cross-sectional view of the terminal module of FIG. 3 to show the glue thereabouts.
Figure 9:
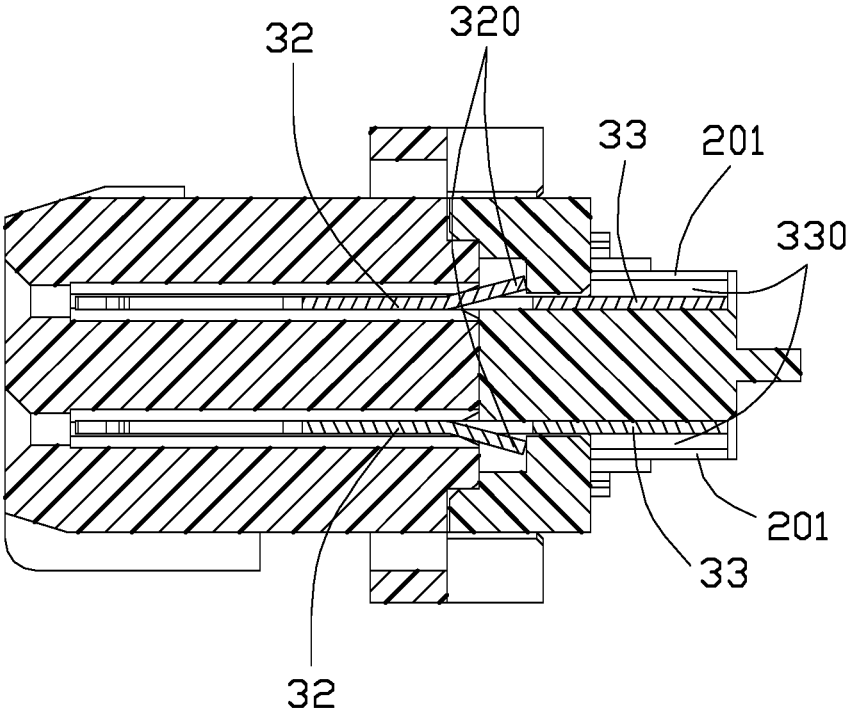
FIG. 9 is another cross-sectional view of the terminal module of FIG. 3 to show how the contact is retained to the fixed part along the front-to-back direction.

FIGS. 8(A) and 8(B) shows the glue is filled within the pilot hole 22 and further invades the diversion tank 112 so as to form an linkage in the transverse direction for avoiding inward deflection of the connecting arm, thus assuring securement between the locking barb 111 and the fixed part 2. FIG. 9 shows the contact 3 is retained to the fixed part 2 by cooperation of the oblique tab 320 and the side protrusions 330 commonly sandwiching the fixed part 2 therebetween in the front-to-back direction.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. An electrical connector comprising:

a housing;

a terminal module mounted in the housing, the terminal module comprising an insulative body, a fixed part mounted on the insulative body extending along a back-to-front direction, and a plurality of terminals, the fixed part defining a mounting hole through the fixed part along front-to-back direction, the insulative body having a connecting arm inserting into and engaging an edge of the mounting hole for positioning the fixed part, the connecting arm having a diversion tank; wherein the fixed part defines a pilot hole extending to the mounting hole, and glue is disposed through the pilot hole into the diversion tank to bond the fixed part with the connecting arm of the insulative body; and the fixed part has a partition arranged around the edge of the mounting hole for preventing the glue from flowing out of the diversion tank.

2. The electrical connector as claimed in claim 1, wherein the connecting arm has a locking barb at an end thereof.

3. The electrical connector as claimed in claim 1, wherein the diversion tank is T-shaped.

4. The electrical connector as claimed in claim 1, wherein a cross section of the mounting hole is quadrilateral, and the partition is a U-shape surrounding three edges of the mounting hole.

5. The electrical connector as claimed in claim 1, wherein the fixed part has a plate extending rearwardly, the terminals mounted on two sides of the plate.

6. The electrical connector as claimed in claim 5, wherein the plate defines a plurality of receiving slots on the two sides, the terminals received in corresponding receiving slots.

7. The electrical connector as claimed in claim 1, wherein the terminal comprises a mating portion forwardly extending beyond the fixed part, a connecting portion received in the receiving slot, and a fixed portion inserted into the fixed part, the fixed portion defining a barb for preventing the terminal from rearwardly disengaging the fixed part.

8. The electrical connector as claimed in claim 1, wherein the insulative body defines a guide post, and the fixed part defines a guide passageway receiving the guide post.

9. An electrical connector comprising: a terminal module including an insulative body defining therein a plurality of mating holes each extending along a front-to-back direction; a plurality of contacts each having a mating portion disposed in the corresponding mating hole and a tail portion exposed outside of the corresponding mating hole; a fixed part forwardly attached to a rear side of the insulative body in said front-to-back direction; one of said insulative body and said fixed part forming a mounting hole therein in the front-to-back direction, and the other forming a deflectable connecting arm extending along the front-to-back direction to inserted into the mounting hole in the front-to-back direction with thereon a locking barb abutting against said one of said insulative body and said fixed part in said front-to-back direction for securement between the insulative body and the a fixed part in said front-to-back direction; and a pilot hole formed in one of said insulative body and said fixed part around both said mounting hole and said deflectable connecting arm and exposed to an exterior; wherein the deflectable connecting arm having a diversion tank; wherein the fixed part defines the pilot hole extending to the mounting hole, and liquid glue is injected through the pilot hole into the diversion tank to bond the fixed part with the deflectable connecting arm of the insulative body so as to prohibit deflection of the deflectable connecting arm; and the fixed part has partition arranged around the edge of the mounting hole for preventing the glue from flowing out of the diversion tank.

10. The electrical connector as claimed in claim 9, wherein said linkage extends along a transverse direction perpendicular to said front-to-back direction.

11. The electrical connector as claimed in claim 9, wherein the connecting arm is formed on the insulative body and the mounting hole is formed in the fixed part.

12. The electrical connector as claimed in claim 11, wherein said pilot hole is formed in the fixed part.

13. The electrical connector as claimed in claim 9, wherein said pilot hole extends and is exposed to the exterior in a transverse direction perpendicular to said front-to-back direction.

14. The electrical connector as claimed in claim 9, wherein the fixed part forms a plurality of through hole each dimensioned similar to a cross-section of the tail portion so as to allow the corresponding contact to be inserted therethrough and into the corresponding mating hole.

15. The electrical connector as claimed in claim 14, wherein the tail portion of each of said contacts forms a pair of side protrusions on two opposite side edges to be not only a stopper to abut against a rear face of the fixed part for preventing forward movement of the contact with regard to the fixed part but also a container to cooperate with the planar body of the tail portion for receiving a corresponding wire soldered on the tail portion.

16. The electrical connector as claimed in claim 15, wherein said fixed part forms a plurality of ribs to form corresponding receiving slots each between every adjacent two ribs, and the tail portion of each contacts is disposed in the corresponding receiving slot with said pair of side protrusions intimately located inside of the corresponding ribs.

17. The electrical connector as claimed in claim 9, wherein a partition is formed on said one of said insulative body and said fixed part around said mounting hole to cover the locking barb in a transverse direction perpendicular to said front-to-back direction.

18. The electrical connector as claimed in claim 9, wherein a glue escape slot is formed in the connecting arm facing said mounting hole in a transverse direction perpendicular to said front-to-back direction.

* * * * *